US006719622B2

(12) United States Patent
Peng

(10) Patent No.: US 6,719,622 B2
(45) Date of Patent: Apr. 13, 2004

(54) SMOKE EXHAUST STRUCTURE

(76) Inventor: Ja-Chun Peng, No. 117, Fu-Tsun Rd., Hou-Li Hsiang, Taichung County (TW)

( * ) Notice: Subject to any disclaimer, the term of this patent is extended or adjusted under 35 U.S.C. 154(b) by 0 days.

(21) Appl. No.: 10/216,933

(22) Filed: Aug. 13, 2002

(65) Prior Publication Data

US 2004/0033775 A1 Feb. 19, 2004

(51) Int. Cl.[7] ..... F24C 15/20
(52) U.S. Cl. ..... 454/67; 126/299 R; 126/299 F
(58) Field of Search ..... 126/299 R, 299 D, 126/299 F; 454/63, 67

(56) References Cited

U.S. PATENT DOCUMENTS 5,027,790 A * 7/1991 Chern ..... 126/299 R
5,230,327 A * 7/1993 Jang et al. ..... 126/299 R
5,311,857 A * 5/1994 Chang ..... 126/299 D
6,240,916 B1 * 6/2001 Huang ..... 126/299 D

* cited by examiner

*Primary Examiner*—Gregory Wilson
(74) *Attorney, Agent, or Firm*—Rosenberg, Klein & Lee

(57) ABSTRACT

A smoke exhaust structure including a housing, a circuit system and a smoke exhaust system. At least one motor is arranged on the housing. The circuit system is connected with the motor and a controller via electric wire. The smoke exhaust system is composed of at least one fan, a wind chamber and at least one oil tank. The smoke exhaust system is an independent passage. The wind chamber communicates with the housing and the circuit system only via at least one through hole which is slightly larger than the motors, permitting the motor to pass therethrough. The wind chamber of the smoke exhaust system is totally isolated from the circuit system and the housing, whereby a user can easily detach the components of the entire smoke exhaust system for cleaning or replacement so as to fully clean up the oily dirt and ensure good smoke exhausting function of the smoke exhaust structure.

8 Claims, 7 Drawing Sheets

SMOKE EXHAUST STRUCTURE

BACKGROUND OF THE INVENTION

A present invention is related to an improved smoke exhaust structure in which the smoke exhaust system can be completely safely and easily detached or replaced. A smoke exhaust system is isolated from a circuit system so that a user can safely detach the components of the smoke exhaust system for cleaning. After a period of use, in the case that internal components are too dirty to wash, without moving the circuit system and other controlling system, these components can be directly quickly replaced with new ones.

A conventional smoke exhaust includes two major systems. One is the circuit control system for controlling a motor and an illuminator. The other is the smoke exhaust system for collectively sucking and exhausting smoke. The two systems are combined with the housing of the smoke exhaust without apparent separation. Therefore, after a period of use, the respective components of the smoke exhaust such as a fan, oil tank, wind chamber and the motor are always contaminated by the oily smoke. This deteriorates the appearance and affects the sucking effect of the smoke exhaust. An improved smoke exhaust includes detachable smoke funnel, oil tank and fan for easy cleaning. However, the circuit and the smoke exhaust system are not separated. Also, the smoke exhaust system is not separated from the housing. As a result, when detached for cleaning, some shortcomings exist as follows:

1. The safety cannot be ensured.
2. Only a part of the smoke exhaust system can be washed.
3. Those components and sections undetachably connected with the circuit system or the housing must be washed with water. However, the circuit is not effectively separated so that the water tends to infiltrate into the circuit to damage the circuit or lead to shock.

FIG. 6 shows a detachable smoke exhaust in which the front end of the rotary shaft 72 of the motor 71 is formed with a threaded section 721. After the fan 78 is fitted on the rotary shaft 72, a nut 73 is screwed onto the thread section 721 to fix the fan 78.

An annular frame strip 74 is disposed on the inner face of the housing around two fans 78 corresponding to the bottom edge of the wind chamber 80 for locating the wind chamber. The frame strip 74 is formed with multiple hooks 75 for latching with the latch members 76 of the wind chamber 80 to fix the wind chamber. The wind chamber 80 and the inner face of the housing define a smoke exhaust space 81.

The bottom board 77 of the smoke funnel is disposed under the wind chamber to cover the bottom face of the housing. When detached for washing, the bolts are unscrewed to detach the smoke funnel. Then the latch members 76 are unlatched to detach the wind chamber. Then the nut 73 is unscrewed to take out the fans 78. At this time, the bottom board 77, wind chamber 80 and the fans 78 can be washed.

Referring to FIG. 7, after the smoke is sucked in by the fans 78, the smoke flows in the smoke exhaust space 81. As a result, the inner face area A of the housing covered by the wind chamber (that is, the panel face of the housing) will be contaminated by the oily dirt. The motor 71 is mounted on the housing 79. The circuit 82 connecting the motor with the bulb and switch extends through the smoke exhaust space 81. Therefore, the circuit control system and the smoke exhaust system are mixed together. Accordingly, when washing the panel face area A of the housing, a user is easy to be shocked. Also, the circuit may be pulled and displaced and the water may infiltrate into the circuit to lead to damage of the smoke exhaust. The section adjacent to the circuit even can be only wiped with a wiper so that it is hard to effectively clean the section.

Moreover, the circuit 82 extending in the smoke exhaust space 81 tends to be contaminated by the oily dirt. However, the circuit 82 is fixed on the housing 79 and hard to touch and wipe. Especially, the oily dirt accumulating on the adjoining sections of the circuit 82 and the housing 79 is hard to clean.

SUMMARY OF THE INVENTION

It is therefore a primary object of the present invention to provide an improved smoke exhaust structure in which the smoke exhaust system can be completely detached for cleaning all faces of the smoke exhaust passage. The smoke exhaust system is totally isolated from the circuit system and the housing so that the smoke will only flow through the smoke exhaust space in the wind chamber. A user can totally detach the wind chamber to entirely detach the components of the smoke exhaust system for cleaning.

It is a further object of the present invention to provide the above smoke exhaust structure in which the circuit system is completely separated from the internal components of the smoke exhaust system. Therefore, when cleaning the surrounding and internal components of the smoke exhaust space, the smoke exhaust system can be entirely taken off for washing without touching the circuit. Therefore, the user can safely wash the. components with water to fully clean up the oily dirt. The smoke exhaust system is totally isolated from the circuit system and the housing so that the oily dirt will not attach to the circuit.

The present invention can be best understood through the following description and accompanying drawings wherein:

DETAILED DESCRIPTION OF THE PREFERRED EMBODIMENTS

Figure 1:
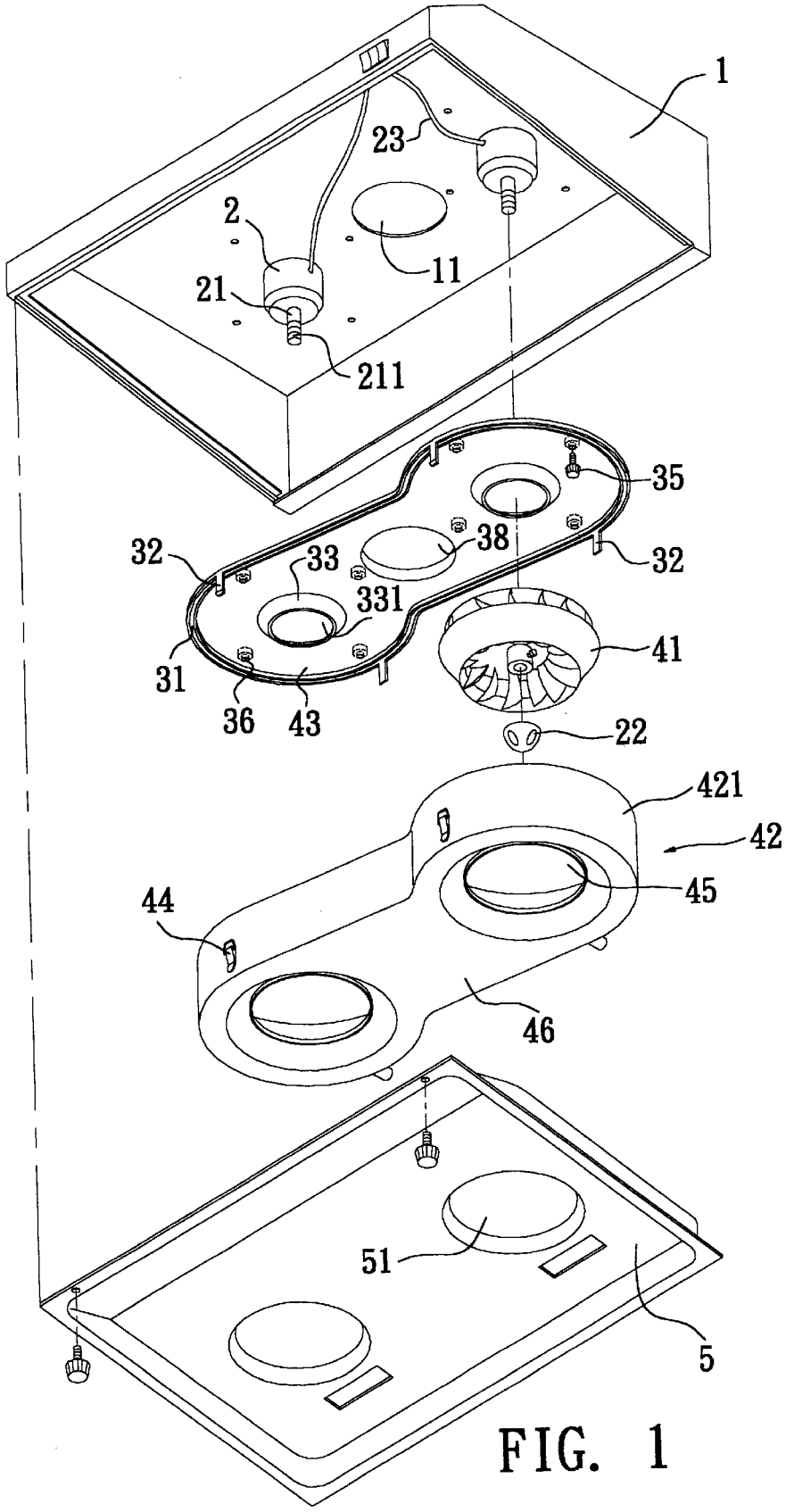
FIG. 1 is a perspective exploded view of the present invention.
Figure 2:
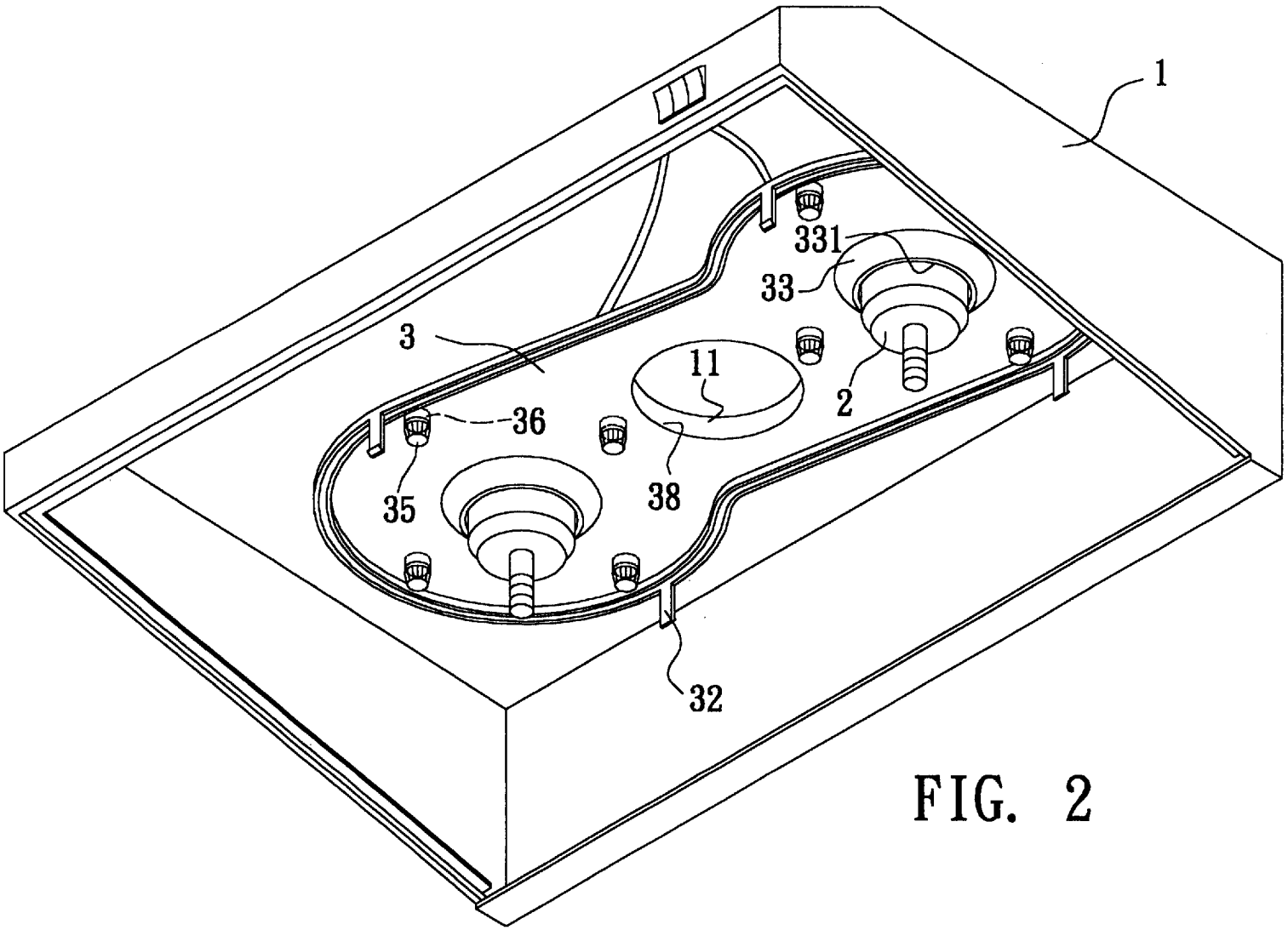
FIG. 2 is a perspective assembled view of the present invention, showing that the circuit is isolated from the smoke exhaust system.
Figure 3:
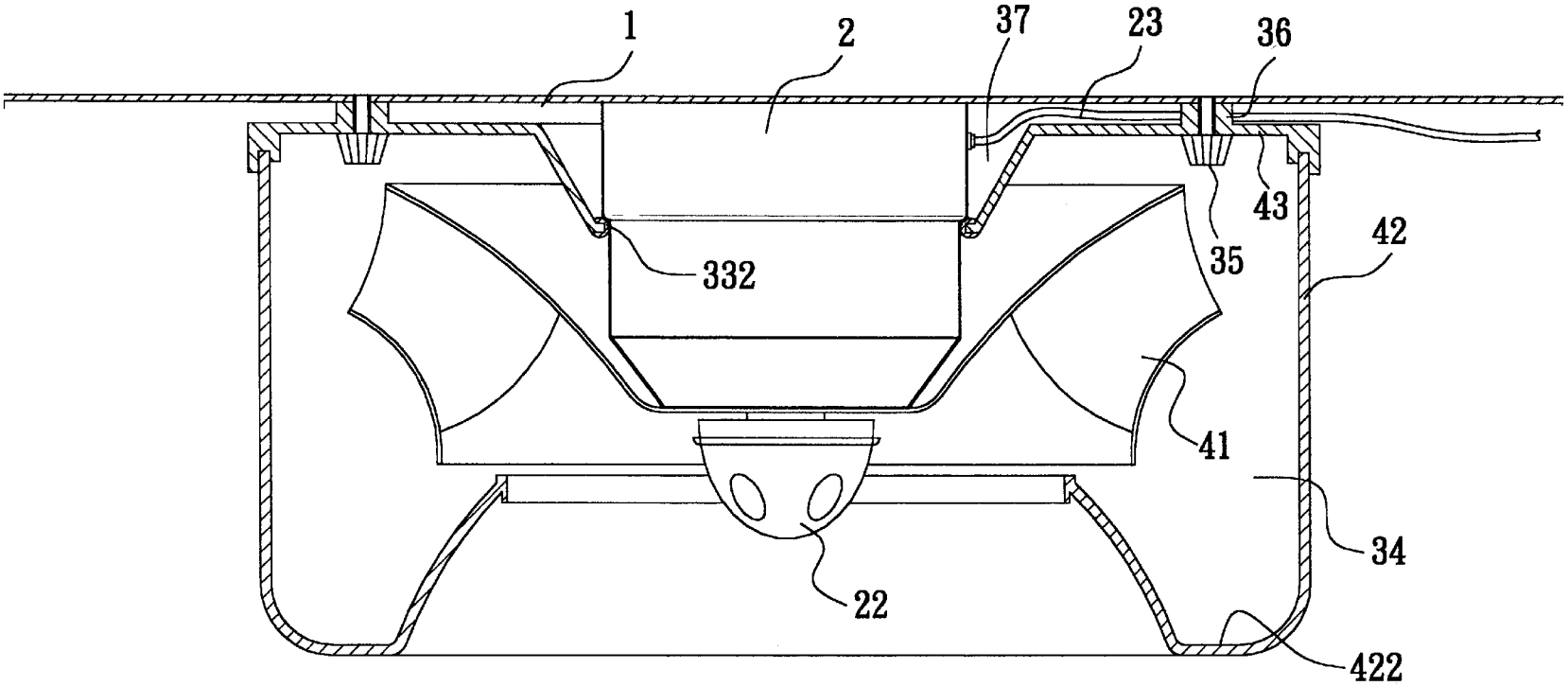
FIG. 3 is a partially sectional view of the present invention.

Please refer to FIGS. 1 to 3. The smoke exhaust structure of the present invention includes a housing 1, a circuit system 23 and a smoke exhaust system entirely detachable from the housing 1.

Two motors 2 are arranged on inner side of the top of the housing 1. The circuit system 23 is connected with the motors and controller via electric wire. The circuit system 23 extends along the inner side of the top of the housing 1. The top of the housing is formed with an exhaust opening 11 for exhausting the smoke.

The smoke exhaust system is an independent passage and composed of two fans 41, wind chamber 42 and oil tank 422. The wind chamber 42 encircles the fans 41 and has a peripheral wall 421. Two sides of the peripheral wall are formed with a first face 43 and a second face 46 opposite to the first face. The peripheral wall 421 seals the wind chamber and defines a smoke exhaust passage 34 in the wind chamber.

The wind chamber communicates with the housing and the circuit system only via through holes 331 which are slightly larger than the motors, permitting the motors to pass therethrough. The smoke exhaust passage of the smoke exhaust system is totally isolated from the circuit system and the housing. The through holes are formed on the first face 43 respectively corresponding to the motors 2 for the motors 2 to pass therethrough. A leakproof washer 332 (as shown in FIG. 3 ) is disposed along the inner circumference of each through hole 331 for contacting with the motor 2. The first face 43 is formed with an opening 38 corresponding to the smoke exhaust opening 11. The fans 41 are respectively mounted on the motors 2 and positioned in the wind chamber 42. A nut 22 is screwed on each fan 41 for fixing the same.

The outer face of the wind chamber proximal to the inner face of the housing is formed with multiple projecting blocks 36 contacting with the inner face of the housing 1. The wind chamber and the inner face of the housing 1 define therebetween a receiving space 37 in which the circuit 23 is isolated.

The second face 46 is formed with two holes 45 respectively corresponding to the fans 41. Through the holes 45, the fans 41 can suck the smoke. The hole 45 is slightly smaller than the outer diameter of the fan. The oil tank 422 is integrally formed on the bottom of the second face 46 (as shown in FIG. 3).

The diameter of the hole 45 is slightly smaller than the outer diameter of the fan 41 so that the fan 41 cannot be first taken out from the smoke exhaust passage 34. In this embodiment, the wind chamber 42 is separable from the first face 43, permitting the wind chamber 42 to be first detached. The first face 43 can be locked on the inner face of the housing 1 by multiple bolts 35.

A bottom board 5 of the smoke funnel covers lower side of the wind chamber 42. The smoke funnel is formed with openings 51 respectively corresponding to the fans 41. Through the openings 51, the fans 41 can suck the smoke on outer side of the smoke exhaust. The smoke is exhausted through the opening 38 and the smoke exhaust opening 11.

Referring to FIG. 3, after the smoke is sucked in by the fans 41, the smoke will only flow in the smoke exhaust passage 34 inside the wind chamber 42. The circuit 23 is separated by the wind chamber and positioned on outer side of the wind chamber 42. Therefore, the circuit will not contact the smoke and thus is prevented from being contaminated by oily dirt. Accordingly, it is unnecessary to wipe the outer side of the circuit so that the danger can be avoided.

Moreover, the entire smoke exhaust system can be detached from the housing 1. That is, the smoke exhaust passage 34 can be entirely detached and fully cleaned. This is impossible in the prior art.

The circuit 23 is completely separated from the internal components of the smoke exhaust passage 34, such as the nuts 22, fans 41, wind chamber 42 and first face 43. Therefore, when detaching the smoke exhaust system, a user is not worried about the problem of displacement of the circuit. Therefore, it is easy to detach the smoke exhaust system. Moreover, when washing the components of the smoke exhaust system, the circuit will not be wetted so that the safety can be ensured. After a period of use, in the case that the internal components are too dirty to wash, these components can be directly replaced with new ones to keep the smoke exhaust having good smoke exhausting function.

Furthermore, when washed, a user only needs to first detach the bottom board of the smoke funnel and then take off the wind chamber and fans. Then the bolts 35 are unscrewed to detach all the components. Similarly, when assembled, the user only needs to tighten the bolts and performs a reverse operation. Such operation is quite easy.

In addition, the inner face of the housing 1 separated on outer side of the smoke exhaust passage 34. Therefore, the smoke entering the smoke exhaust passage 34 is not easy to infiltrate into the receiving space 37 between the wind chamber and the inner face of the housing. Accordingly, the oily dirt will not attach to the inner face of the housing 1. Therefore, it is unnecessary to clean the inner face of the housing 1 so that the problem that it is difficult to clean the inner face of the housing 1 existing in the prior art is overcome.

Figure 4:
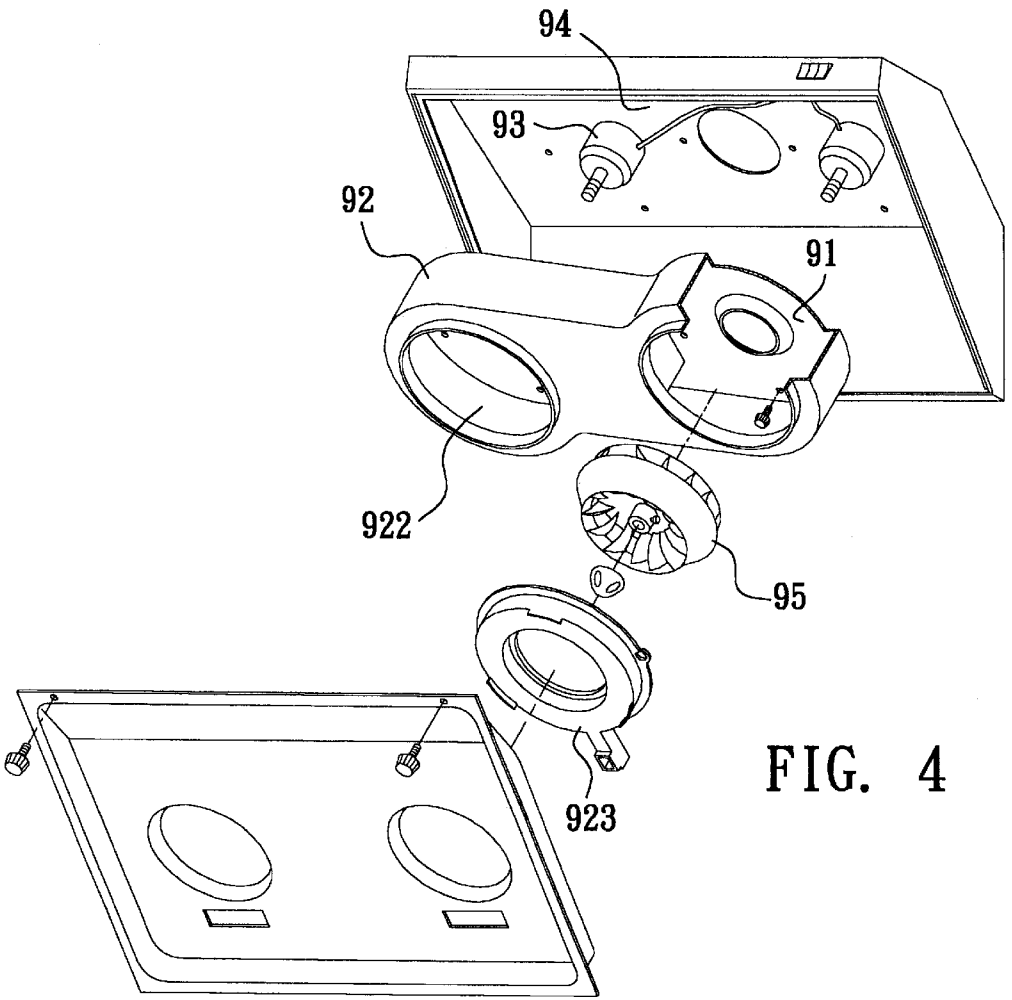
FIG. 4 is a perspective exploded view of a second embodiment of the present invention.

FIG. 4 shows a second embodiment of the present invention, which is different from the first embodiment in that the first face 91 is welded with the circumference of the peripheral wall of the wind chamber 92. The wind chamber 92 has a hole 922 with a diameter larger than the outer diameter of the fan 95. The circumference of the hole is provided with an oil tank 923 detachable from the wind chamber. The oil tank can be installed by means of locking members such as bolts by any of those skilled in this field. The top face 94 of the smoke exhaust is slightly downward inclined, whereby the motors 93 mounted on the top face 94 are also inclined. This is a design of slope back-type smoke exhaust.

When cleaned, the oil tank 923 is first taken off from the wind chamber 92. Then the fans 95 are detached and taken out from the holes 922. Then the entire wind chamber is taken off. The second embodiment can achieve the same function as the first embodiment.

Figure 5:
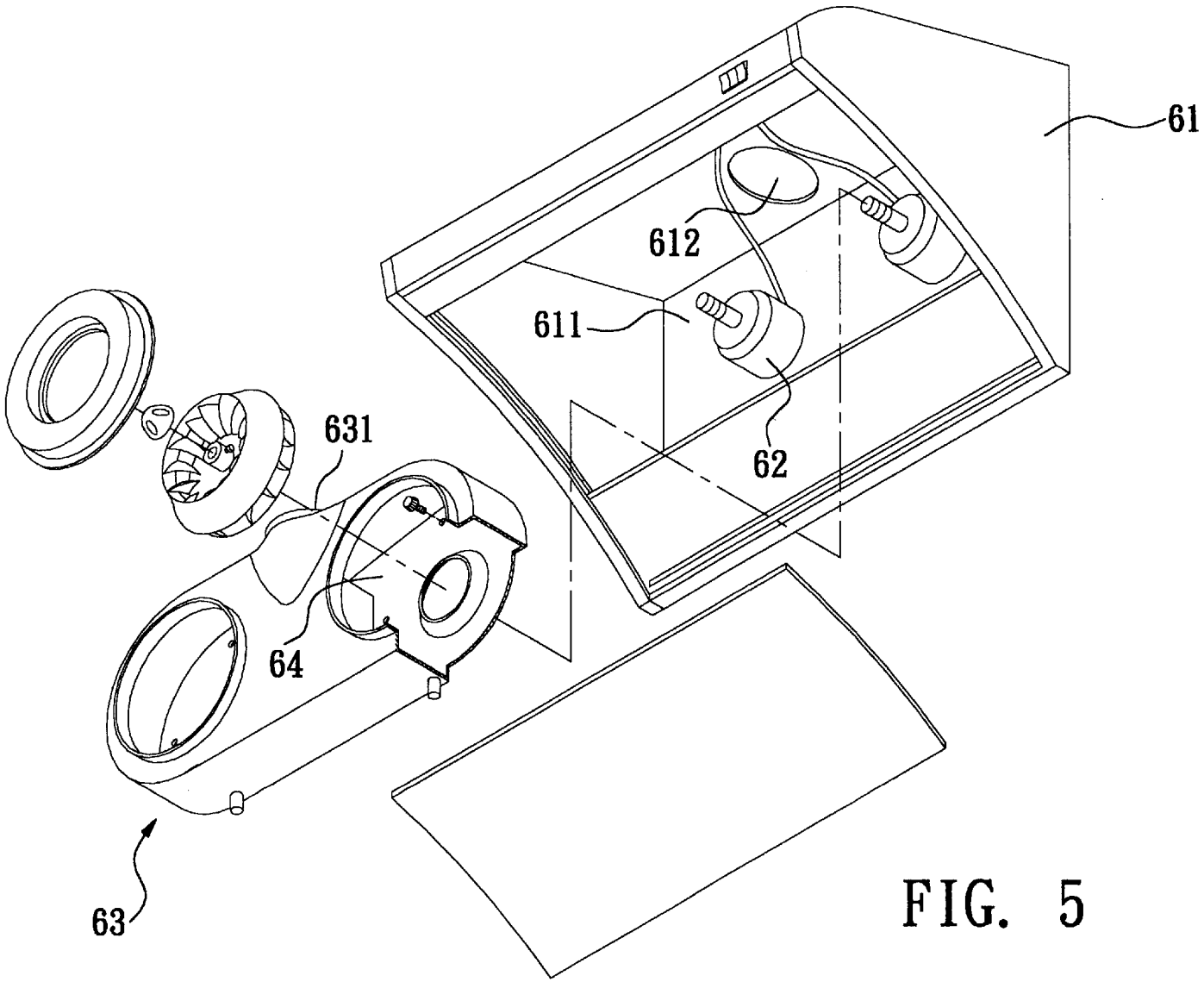
FIG. 5 is a perspective exploded view of a third embodiment of the present invention.
Figure 6:
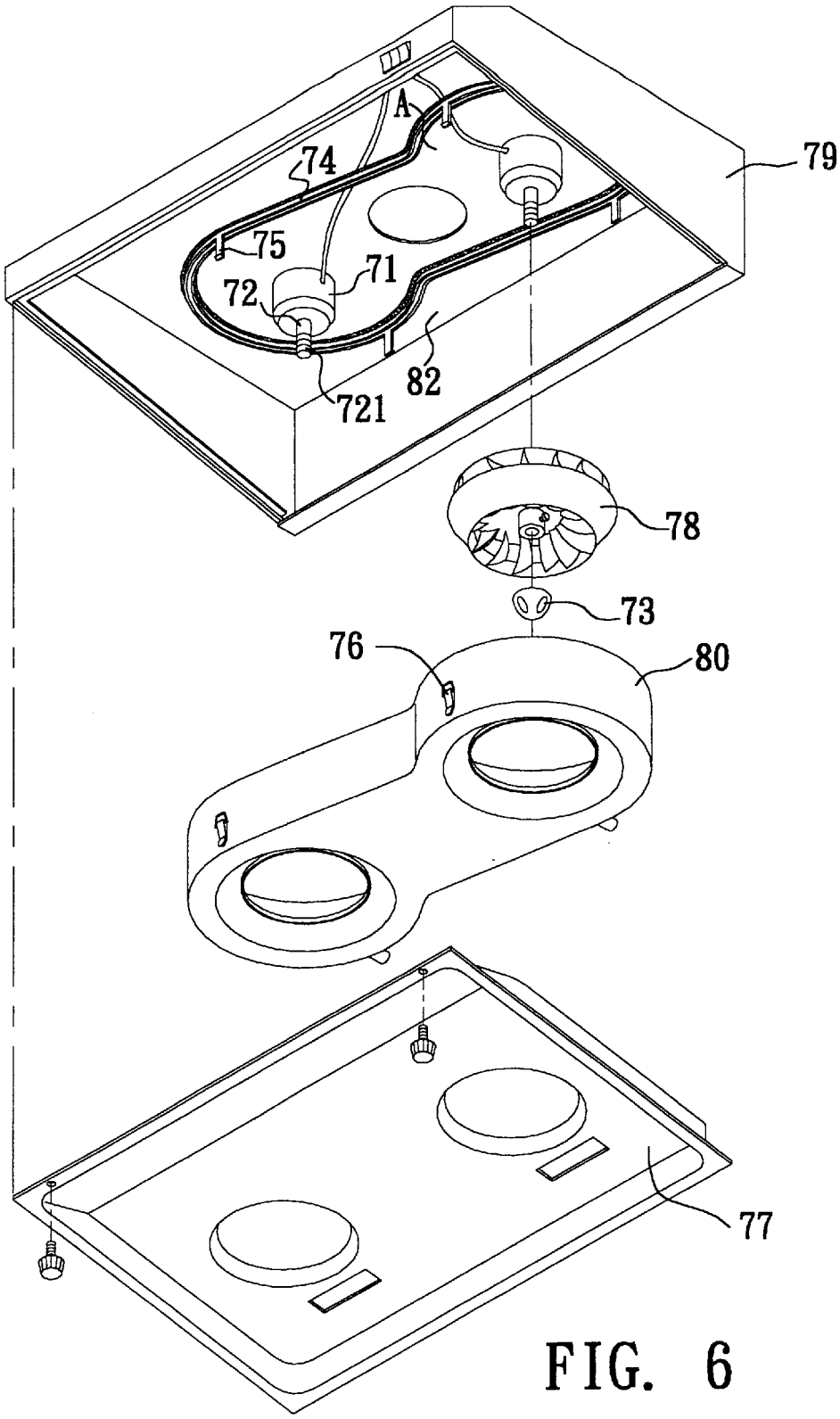
FIG. 6 PRIOR ART
FIG. 6 is a perspective exploded view of a conventional smoke exhaust.
Figure 7:
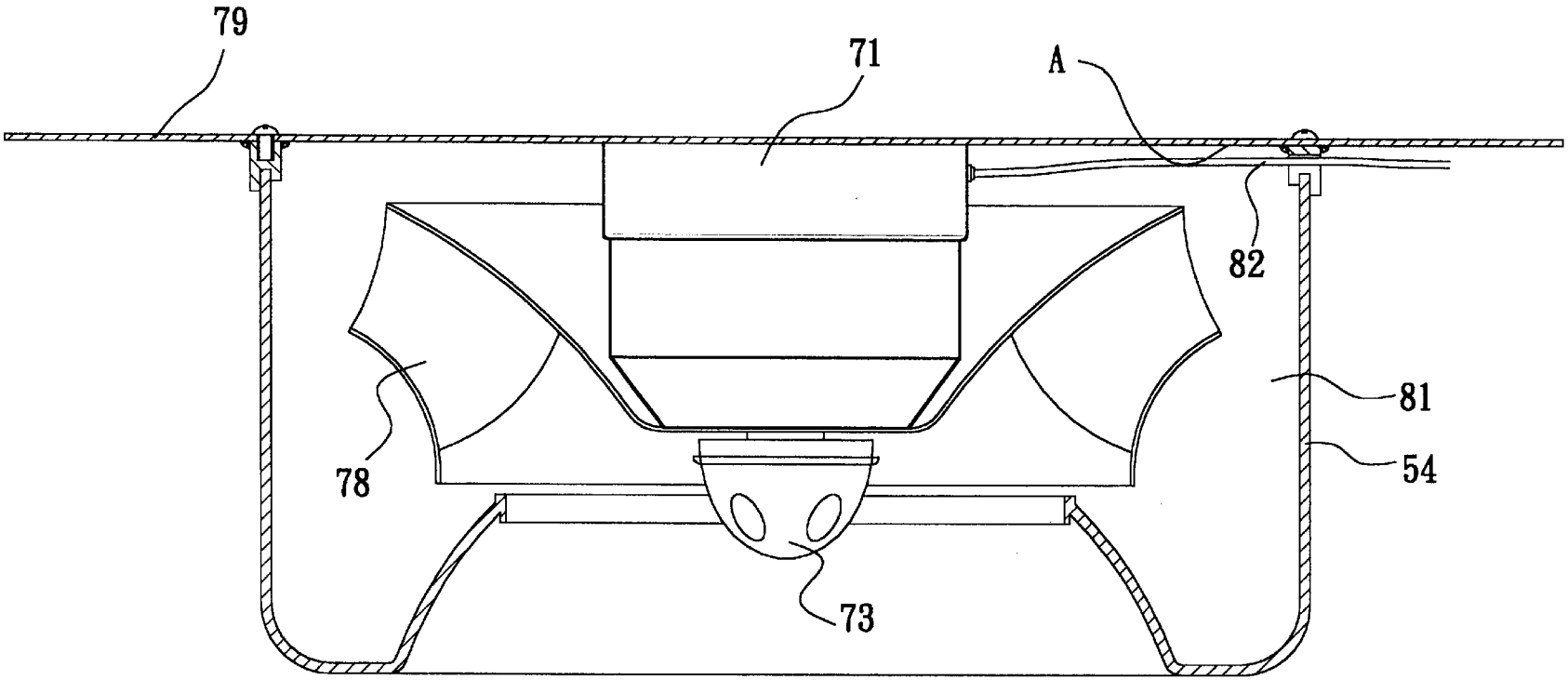
FIG. 7 PRIOR ART
FIG. 7 is a partially sectional view of the conventional smoke exhaust.

FIG. 5 shows a third embodiment of the present invention, which is different from the second embodiment in that the smoke exhaust has an upright smoke exhaust system. The motors 62 are arranged on the inner face 611 of a vertical side wall of the housing 61 attaching to a wall. The top face of the wind chamber is formed with an opening 631 corresponding to the smoke exhaust opening 612 of the housing. The smoke entering the smoke exhaust passage 64 can be sucked through the opening 631 and the smoke exhaust opening 612 and exhausted.

The above embodiments are only used to illustrate the present invention, not intended to limit the scope thereof. Many modifications of the above embodiments can be made without departing from the spirit of the present invention.

What is claimed is:

1. A smoke exhaust structure comprising a housing, a circuit system and a smoke exhaust system, at least one motor being arranged on the housing, the circuit system being connected with the motor and a controller via electric wire, the smoke exhaust system being composed of at least one fan, a wind chamber and at least one oil tank, the smoke exhaust system being an independent passage, the wind chamber communicating with the housing and the circuit system only via at least one through hole which is slightly larger than the motors, permitting the motor to pass therethrough, said smoke exhaust structure being characterized in that the wind chamber of the smoke exhaust system is totally isolated from the circuit system and the housing, whereby a user can easily detach the components of the entire smoke exhaust system for cleaning or replacement so as to fully clean up the oily dirt and ensure good smoke exhausting function of the smoke exhaust structure.

2. The smoke exhaust structure as claimed in claim 1, wherein the smoke exhaust system and the motor are locked in the housing and inclined from rear wall of the housing.

3. The smoke exhaust structure as claimed in claim 1, wherein the smoke exhaust system and the motor are locked on a vertical rear wall of the housing.

4. The smoke exhaust structure as claimed in claim 1, wherein the wind chamber has a peripheral wall, two sides of the peripheral wall being formed with a first face and a second face opposite to the first face, the peripheral wall sealing the wind chamber and defining a smoke exhaust passage in the wind chamber, the first face facing the inner face of the housing, the circuit system and the housing are positioned on outer side of the smoke exhaust passage.

5. The smoke exhaust structure as claimed in claim 4, wherein the first face is separated from the wind chamber and the first face is locked on inner face of the housing by multiple bolts.

6. The smoke exhaust structure as claimed in claim 4, wherein an outer face of the first face proximal to the inner face of the housing and the inner face of the housing define therebetween a receiving space through which the circuit passes.

7. The smoke exhaust structure as claimed in claim 4, wherein the circumference of the first face is welded with the circumference of the peripheral wall of the wind chamber.

8. The smoke exhaust structure as claimed in claim 1, wherein a leakproof washer is disposed along the inner circumference of the through hole.

* * * * *

UNITED STATES PATENT AND TRADEMARK OFFICE

CERTIFICATE OF CORRECTION

PATENT NO. : 6,719,622 B2
DATED : April 13, 2004
INVENTOR(S) : Ta – Chun Peng

It is certified that error appears in the above-identified patent and that said Letters Patent is hereby corrected as shown below:

Title page,
Item [76], Inventors, delete the name "Ja-Chun Peng" and insert the name -- Ta-Chun Peng --.

Signed and Sealed this

Twenty-fifth Day of May, 2004

JON W. DUDAS
*Acting Director of the United States Patent and Trademark Office*